US010366703B2

(12) United States Patent
Lee et al.

(10) Patent No.: US 10,366,703 B2
(45) Date of Patent: Jul. 30, 2019

(54) METHOD AND APPARATUS FOR PROCESSING AUDIO SIGNAL INCLUDING SHOCK NOISE

(71) Applicant: SAMSUNG ELECTRONICS CO., LTD., Suwon-si (KR)

(72) Inventors: Young-woo Lee, Seoul (KR); Haruyuki Mori, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/516,071

(22) PCT Filed: Oct. 1, 2015

(86) PCT No.: PCT/KR2015/010370
§ 371 (c)(1),
(2) Date: Mar. 31, 2017

(87) PCT Pub. No.: WO2016/053019
PCT Pub. Date: Apr. 7, 2016

(65) Prior Publication Data

US 2017/0309293 A1 Oct. 26, 2017

Related U.S. Application Data

(60) Provisional application No. 62/058,267, filed on Oct. 1, 2014, provisional application No. 62/058,252, filed on Oct. 1, 2014.

(51) Int. Cl.
*G10L 21/0208* (2013.01)
*H04R 3/00* (2006.01)
(Continued)

(52) U.S. Cl.
CPC ..... *G10L 21/0232* (2013.01); *H04R 3/005* (2013.01); *G10L 2021/02166* (2013.01);
(Continued)

(58) Field of Classification Search
CPC ..... G10L 21/0208; H04R 3/005; H04R 1/406
(Continued)

(56) References Cited

U.S. PATENT DOCUMENTS 7,181,031 B2 2/2007 Ludvigsen
7,983,425 B2 7/2011 Luo
(Continued)

FOREIGN PATENT DOCUMENTS

KR 10-2008-0002990 A 1/2008
KR 10-2011-0057596 A 6/2011
(Continued)

OTHER PUBLICATIONS

Written Opinion dated Jan. 14, 2016 issued by International Searching Authority in counterpart International Application No. PCT/KR2015/010370 (PCT/ISA/237).
(Continued)

*Primary Examiner* — Farzad Kazeminezhad
(74) *Attorney, Agent, or Firm* — Sughrue Mion, PLLC

(57) ABSTRACT

A method of processing an audio signal is provided. The method includes: acquiring an audio signal of a frequency domain for a plurality of frames; dividing a frequency band into a plurality of sections; acquiring energies of the plurality of sections; detecting an audio signal including noise based on an energy difference between the plurality of sections; and applying a suppression gain to the detected audio signal.

14 Claims, 8 Drawing Sheets

(51) Int. Cl.
*H04R 1/40* (2006.01)
*G10L 21/0232* (2013.01)
*G10L 21/0216* (2013.01)

(52) U.S. Cl.
CPC ..... *H04R 1/403* (2013.01); *H04R 2499/11* (2013.01); *H04R 2499/15* (2013.01)

(58) Field of Classification Search
USPC ..... 704/226; 381/73.1
See application file for complete search history.

(56) References Cited

U.S. PATENT DOCUMENTS 8,676,571 B2 3/2014 Otani et al.
8,731,915 B2 5/2014 Shin
8,842,861 B2 9/2014 Westermann et al.
9,386,162 B2 7/2016 Yang et al.
9,918,162 B2 * 3/2018 Asada ..... H04R 1/406
2005/0240401 A1 * 10/2005 Ebenezer ..... G10L 21/0208 704/226
2008/0260175 A1 * 10/2008 Elko ..... H04R 3/005 381/73.1
2009/0177475 A1 * 7/2009 Kato ..... G10L 13/06 704/260
2014/0193009 A1 7/2014 Yousefian Jazi et al.

FOREIGN PATENT DOCUMENTS

KR 10-1254989 B1 4/2013
KR 10-2013-0045867 A 5/2013
WO 2010/146711 A1 12/2010

OTHER PUBLICATIONS

International Search Report dated Jan. 14, 2016 issued by International Searching Authority in counterpart International Application No. PCT/KR2015/010370 (PCT/ISA/210).

* cited by examiner

METHOD AND APPARATUS FOR PROCESSING AUDIO SIGNAL INCLUDING SHOCK NOISE

TECHNICAL FIELD

The present disclosure relates to methods and apparatuses for processing an audio signal including noise.

BACKGROUND ART

A hearing device may amplify an external sound and deliver the amplified external sound to a user. The user may better recognize a sound through the hearing device. However, the user may be exposed to various noise environments in everyday lives. Therefore, if the hearing device outputs an audio signal without appropriately removing noise included in the audio signal, the user may feel inconvenient.

Therefore, there is a need for a method of processing an audio signal to reduce a sound quality distortion and remove noise.

DISCLOSURE

Technical Solution

Provided are methods and apparatuses for processing an audio signal including noise to reduce a sound quality distortion and remove the noise.

Advantageous Effects

According to a method of processing an audio signal according to an exemplary embodiment, a distortion of a sound quality of an audio signal may be reduced, and noise included in the audio signal may be effectively removed.

BEST MODE

Figure 1:
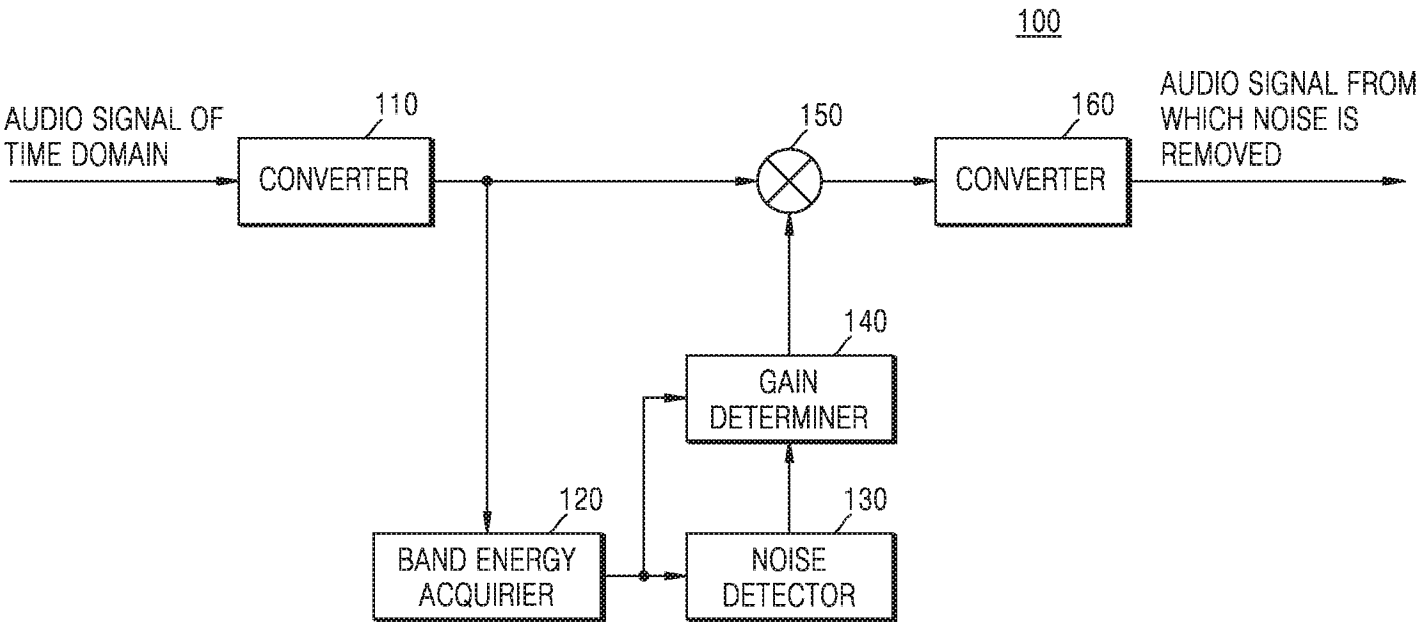
FIG. 1 illustrates an internal configuration of a terminal device for processing an audio signal according to an exemplary embodiment.

According to an aspect of an exemplary embodiment, a method of processing an audio signal, includes: acquiring an audio signal of a frequency domain for a plurality of frames; dividing a frequency band into a plurality of sections; acquiring energies of the plurality of sections; detecting an audio signal including noise based on an energy difference between the plurality of sections; and applying a suppression gain to the detected audio signal.

The detecting of the audio signal including the noise may include: acquiring energies of the plurality of frames; and detecting an audio signal including noise based on at least one selected from an energy difference between the plurality of frames and an energy value of a certain frame.

The applying of the suppression gain may include determining the suppression gain based on energy of the audio signal from which the noise is detected.

The energy difference between the frequency bands may be a difference between energy of a first frequency section and energy of a second frequency section, and the second frequency section may be a section of a frequency band higher than the first frequency section.

According to an aspect of another exemplary embodiment, a method of processing an audio signal, includes: acquiring a front signal and a back signal; acquiring a coherence between the back signal, to which a delay is applied, and the front signal; determining a gain value based on the coherence; and acquiring a difference between the back signal, to which the delay is applied, and the front signal to acquire a fixed beamforming signal; and applying the gain value to the fixed beamforming signal and then outputting the fixed beamforming signal.

The acquiring of the coherence may include: dividing a frequency band into at least two sections; and acquiring the coherence of a high frequency section of the divided sections. The determining of the gain value may include: determining a directivity of a target signal of the audio signal based on the coherence of the high frequency section; and determining a gain value of a low frequency section of the divided sections based on the directivity.

The determining of the gain value may include: estimating noise of the front signal; and determining a gain value of the low frequency section based on the estimated noise.

According to an aspect of another exemplary embodiment, a terminal device for processing an audio signal, includes: a receiver configured to acquire an audio signal of a frequency domain for a plurality of frames; a controller configured to divide a frequency band into a plurality of sections, acquire energies of the plurality of sections, detect an audio signal including noise based on an energy difference between the plurality of sections, and apply a suppression gain to the detected audio signal; and an outputter configured to convert the audio signal processed by the controller into a signal of a time domain and output the signal of time domain.

According to an aspect of another exemplary embodiment, a terminal device for processing an audio signal, includes: a receiver configured to acquire a front signal and a back signal; a controller configured to acquire a coherence between the back signal, to which a delay is applied, and the front signal, determine a gain value based on the coherence, acquire a difference between the back signal, to which the delay is applied, and the front signal to acquire a fixed beamforming signal, and apply the gain value to the fixed beamforming signal; and an outputter configured to convert the fixed beamforming signal, to which the gain value is applied, into a signal of a time domain and output the signal of the time domain.

MODE FOR INVENTION

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects. Expressions such as "at least one of," when preceding a list of elements, modify the entire list of elements and do not modify the individual elements of the list.

The terms or words used in the present specification and claims that will be described herein are not construed as being limited to general or dictionary meanings. The inventor construes the terms or words as meanings and concepts meeting the technical scope of the exemplary embodiments based on a principle of appropriately defining the terms or words as terms for describing the invention in the best way. Therefore, elements illustrated in described exemplary embodiments and drawings are exemplary and do not represent the technical scope of the exemplary embodiments. It will be understood that there may be various equivalents and modifications replacing these at the present patent application time.

Some elements illustrated in the attached drawings are exaggerated, omitted, or schematically illustrated, and sizes of the elements do not completely reflect actual sizes. However, the sizes of the elements are not limited by relative sizes or distances drawn in the attached drawings.

As used herein, when an element is referred to as "comprising" another element, the other element may be further included but is not excluded as there is no particular contrary description. Also, when an element is referred to as being "connected or coupled to" another element, the element may be referred to as being "directly connected or coupled to" or "electrically connected to" another element, or intervening elements may be present.

The singular forms are intended to include the plural forms as well, unless the context clearly indicates otherwise. It will be further understood that the terms "comprises", "comprising", "includes", and/or "including" when used in this specification, specify the presence of stated features, integers, steps, operations, elements, and/or components, but do not preclude the presence or addition of one or more other features, integers, steps, operations, elements, components, and/or groups thereof.

The term "unit" used herein refers to a hardware element such as field-programmable gate array (FPGA) or application-specific integrated circuit (ASIC) and performs any role. However, the term "unit" is not limited to software or hardware. The "unit" may be constituted to be in a storage medium that may be addressed or may be constituted to play one or more processors. Therefore, for example, the "unit" includes elements, such as software elements, object-oriented elements, class elements, and task elements, processes, functions, attributes, procedures, sub routines, segments of a program code, drivers, firmware, a microcode, a circuit, data, a database (DB), data structures, tables, arrays, and parameters. Functions provided in elements and "units" may be combined as the smaller number of elements and "units" or may be separated as additional elements and "units".

The exemplary embodiments will be described in detail with reference to the attached drawings to be easily embodied by those of ordinary skill in the art. However, the exemplary embodiments are not limited and thus may be embodied in several different forms. Also, parts that are not associated with descriptions will be omitted in the drawings to clearly describe the exemplary embodiments, and like reference numerals denote like elements throughout the description of the drawings.

Hereinafter, the exemplary embodiments will be described with reference to the attached drawings.

FIG. 1 illustrates an internal configuration of a terminal device 100 for processing an audio signal according to an exemplary embodiment.

Referring to FIG. 1, the terminal device 100 may include converters 110 and 160, a band energy acquirer 120, a noise detector 130, and a gain determiner 140.

The terminal device 100 may be a terminal device that may be used by a user. For example, the terminal device 100 may include a hearing device, a smart television (TV), a ultra high definition (UHD) TV, a monitor, a personal computer (PC), a notebook computer, a mobile phone, a tablet PC, a navigation terminal, a smartphone, a personal digital assistant (PDA), a portable multimedia player (PMP), and a digital broadcast receiver. The terminal device 100 is not limited to the above-described example and may include various types of devices.

The terminal device 100 may include a microphone capable of receiving a sound generated from an outside to receive an audio signal through the microphone or receive an audio signal from an external apparatus. The terminal device 100 may detect noise from the received audio signal and apply a suppression gain to a section from which the noise is detected, to remove noise included in the audio signal. The suppression gain may be applied to the audio signal to reduce a size of the audio signal.

Noise that may be included in the audio signal may refer to a signal except a target signal. The target signal may, for example, be a speech signal that the user wants to hear. The noise may, for example, include living noise or a shock sound except the target signal. If the audio signal includes the shock sound having large energy for a short time interval, the user is difficult to appropriately recognize the target signal due to the shock sound. Therefore, the terminal device 100 may remove the shock sound from the audio signal and then output the audio signal. The terminal device 100 may detect a section including noise except the target signal from the audio signal to apply the suppression gain for removing the noise to the audio signal.

The converter 110 may convert a received audio signal of a time domain into an audio signal of a frequency domain. For example, the converter 110 may perform Discrete Fourier Transform with respect to the audio signal in the time domain to acquire the audio signal of the frequency domain including a plurality of frames. According to a method of detecting noise in a time domain, a shock sound generated on an initial stage may not be removed, and thus a delay time may occur. However, the terminal device 100 may process the audio signal in the frequency domain in unit of frames to remove noise from the audio signal and then output the audio signal in real time without a delay time in comparison with a method of processing noise in a time domain.

The band energy acquirer 120 may acquire energy of a certain frequency section by using the audio signal of the frequency domain. The band energy acquirer 120 may divide a frequency band into two or more frequency sections and acquire energy of each of the two or more frequency sections. Energy may be expressed with a norm value, a strength, an amplitude, a decibel value, or the like. For example, energy of each frequency section may be acquired as in Equation 1 below:

$$Y_{ch_N}(n) = 20 * \log10\left\{\text{mean}\left(\sum_{f=f(N)}^{f(N+1)} Y_{in}(w_f, n)\right)\right\} \quad (1)$$

wherein Y(w,n) denotes an energy value of a frequency ω in a frame n. A log transformation may be performed with respect to an average value of energy values included in a certain frequency section so as to enable $Y_{ch_N}(n)$ to have an energy value of a decibel (dB) unit. Energy of a certain frequency section may be determined as a representative value of an average value, an intermediate value, or the like of energy values of frequencies included in the certain frequency section. The energy of the certain frequency section is not limited to the above-described example and may be determined according to various methods.

The noise detector 130 may detect a section, in which noise exists, based on the energy of each of the frequency sections acquired by the band energy acquirer 120. The noise detector 130 may detect an audio signal including noise based on an energy difference between frequency sections. The noise detector 130 may determine whether the noise is included in the audio signal, in unit of frames.

An audio signal including a shock sound among noise has very large energy for a short time. Therefore, if the audio signal including the shock sound is transmitted to the user, the user may feel inconvenient due to a very large sound. The shock sound may have very large energy for a short time, and energy of the shock sound may be concentrated in a high frequency band. Therefore, if the audio signal includes the shock sound, energy of the high frequency band may be larger than energy of a low frequency band.

The noise detector 130 may detect the audio signal including the shock sound by using a characteristic of the audio signal including the shock sound. The noise detector 130 may detect the audio signal including the shock sound by using the energy of each of the frequency sections acquired by the band energy acquirer 120. The noise detector 130 may detect the audio signal including the shock sound based on a difference or a ratio between energy of a low frequency section and energy of a high frequency section. For example, an energy difference between frequency sections may be acquired as in Equation 2 below:

$$\text{banddiff}=Y_{ch_L}(n)-Y_{ch_H}(n) \quad (2)$$

wherein $Y_{ch_L}(n)$ and $Y_{ch_H}(n)$ respectively denote energy of a low frequency section and energy of a high frequency section. According to Equation 2 above, a difference value between the energy of the low frequency section and the energy of the high frequency section may be used to detect a shock sound. However, a ratio between the energy of the low frequency section and the energy of the high frequency section may be used to detect the shock sound instead of the different value. Energy between low frequency sections or high frequency sections may be determined as a representative value of energies of frequencies included in sections acquired according to Equation 1 above.

If energy of a high frequency section is larger than or equal to a reference value in comparison with energy of a low frequency section, the noise detector 130 may determine that a corresponding audio signal includes a shock sound.

Therefore, according to an exemplary embodiment, a shock sound may be detected based on an energy difference or ratio between frequency sections. Therefore, although a target signal becomes suddenly larger, a probability that a wrong determination of the target signal as the shock sound will distort a sound quality may be lowered. For example, although a voice of a speaker becomes suddenly louder, there is a high probability of an energy difference or ratio between frequency sections being maintained. Therefore, a probability of the target signal being wrongly determined as the shock sound may be lowered.

Also, the noise detector 130 may detect the audio signal including the noise in consideration of a rapid increase in energy of the audio signal including the noise for a short time. The noise detector 130 may further determine whether an energy difference of an audio signal between frames is higher than or equal to a reference value to determine whether the corresponding audio signal includes a shock sound. Energy of a certain frame may be acquired from a sum value of the energies of the frequency sections acquired by the band energy acquirer 120. For example, an energy difference between frames may be acquired as in Equation 3 below:

$$\text{framediff_}Y_{ch_N}=Y_{ch_N}(n)-Y_{ch_N}(n-1) \quad (3)$$

wherein $Y_{ch_N}(n)$ and $Y_{ch_N}(n-1)$ respectively energy of a frame n and energy of a frame n−1. Energy of a certain frame may be acquired according to Equation 1 above.

If an audio signal does not have absolutely large energy, a large shock may not be applied to the user. Therefore, the corresponding audio signal may not need processing for removing a shock sound. Therefore, the noise detector 130 may determine whether energy of a current frame is higher than or equal to a certain reference value, in consideration of a fact that an audio signal including a shock sound has absolutely large energy.

As in Equation 4 below, the noise detector 130 may determine whether an audio signal of a current frame includes a shock sound, based on an energy difference between frames, an energy difference between frequency sections, and an energy size of a current frame.

$$if(Y_{CH_N}(n)>Y_{th} \;\&\; \text{framediff_}Y_{ch_N}>fd_{th} \;\&\; \text{banddiff}>bd_{th})\text{Shock Index=true} \quad (4)$$

wherein $Y_{th}$, $fd_{th}$, and $bd_{th}$ respectively denote an energy size of a current frame, an energy difference between frames, and an energy difference between frequency sections. According to Equation 4 above, a shock sound may be detected based on the energy difference between the frames, the energy difference between the frequency sections, and the energy size of the current frame but is not limited thereto. Therefore, the shock sound may be detected based on one of the above-described values.

The gain determiner 140 may determine a suppression gain value. The suppression gain value may be applied to an audio signal that is determined as including a shock sound by the noise detector 130. A size of the audio signal including the shock sound may be reduced through the application of the suppression gain value to the audio signal.

For example, the suppression gain value may be determined as in Equation 5 below:

$$if(\text{Shock Index=true})$$

$$G(w,n)=f\{Y_{ch_N}(w_N,n),\text{MaxGain}\} \quad (5)$$

wherein G (w,n) denotes a suppression gain value that may be applied to a frequency ω of an audio signal of a frame n, and $Y_{ch_N}(w_N, n)$ denotes an audio signal to which a suppression gain is applied. As in Equation 5 above, the suppression gain may be determined according to an energy size of the audio signal to which the suppression gain is applied. Also, the suppression gain may be determined to be lower than or equal to a maximum value MaXGain. However, the suppression gain is not limited thereto and thus may be determined according to various methods.

The suppression gain determined by the gain determiner 140 may be applied to an audio signal of a frequency domain through an operator 150. The audio signal to which the suppression gain is applied may be converted into an audio signal of a time domain by the converter 160 and then output.

Figure 2:
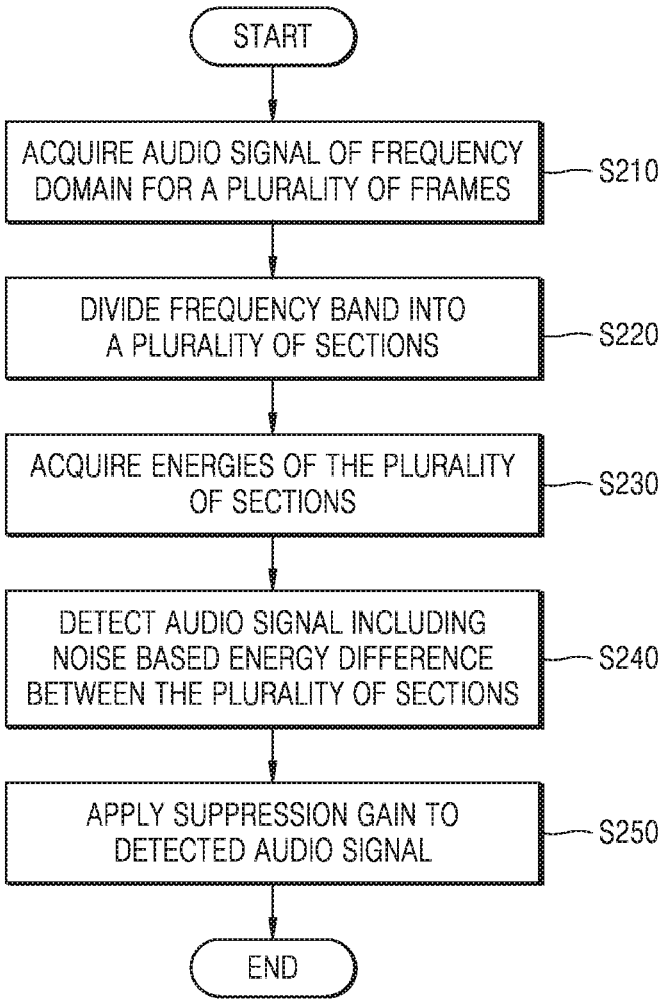
FIG. 2 is a flowchart of a method of processing an audio signal according to an exemplary embodiment.

FIG. 2 is a flowchart of a method of processing an audio signal according to an exemplary embodiment.

Referring to FIG. 2, in operation S210, the terminal device 100 may acquire an audio signal of a frequency domain for a plurality of frames. The terminal device 100 may convert a received audio signal of a time domain into an audio signal of a frequency domain.

The terminal device 100 divides a frequency band into a plurality of sections in operation S220 and acquires energies of the plurality of sections in operation S230. The energies of the sections may be determined as a representative value such as an average value, an intermediate value, or the like of energy values of respective frequencies.

In operation S240, the terminal device 100 detects an audio signal including noise based on an energy difference between the plurality of sections. For example, the terminal device 100 may detect an audio signal including a shock sound based on an energy difference or rate between a low frequency section and a high frequency section. The terminal device 100 may detect the audio signal including the shock sound in unit of frames.

In operation S250, the terminal device 100 applies a suppression gain to the audio signal detected in operation S240. As the suppression gain is applied to the audio signal, an energy size of the audio signal may become smaller. As the energy size of the audio signal including the shock sound becomes smaller, the audio signal from which the shock sound is removed may be output.

Figure 3:
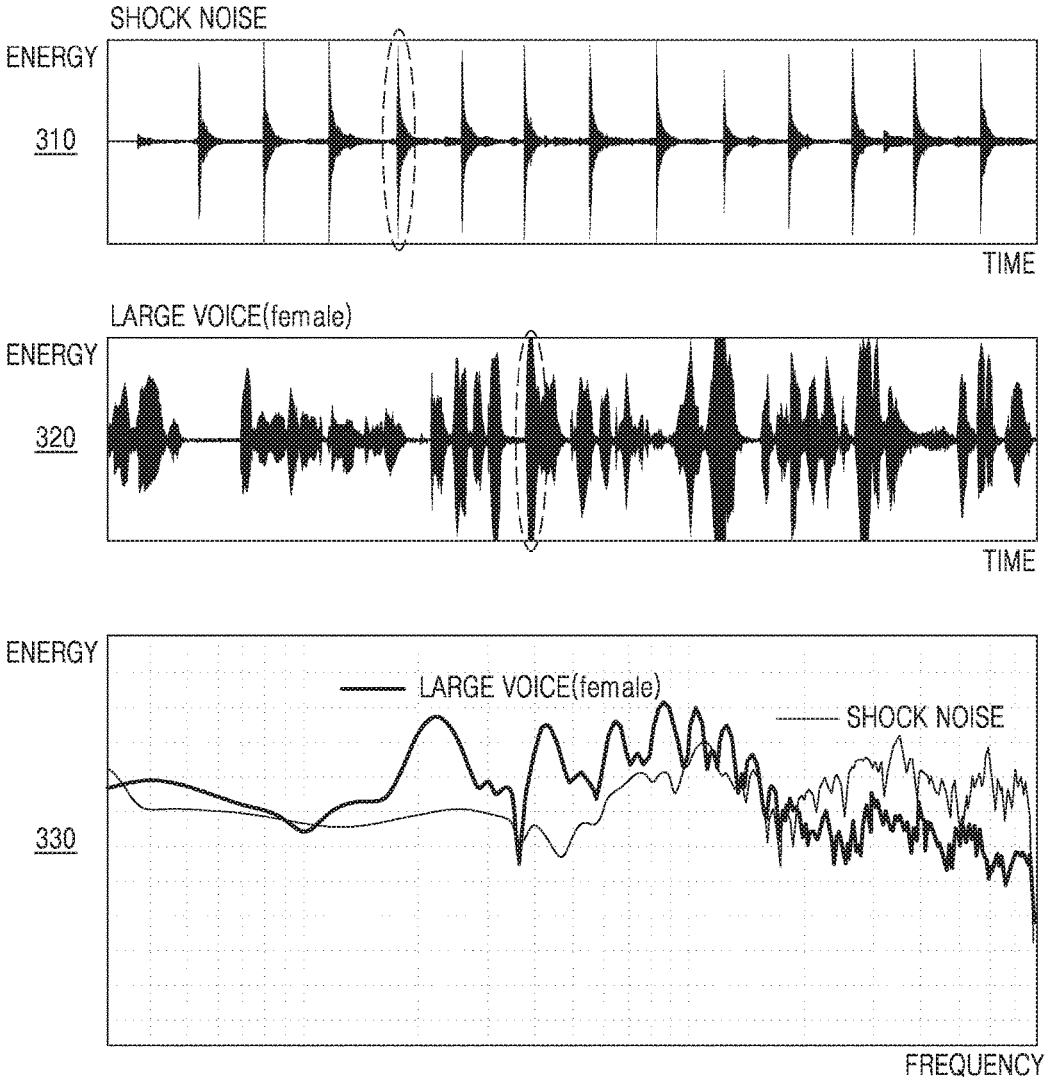
FIG. 3 illustrates a shock sound and a target signal according to an exemplary embodiment.

FIG. 3 illustrates a shock sound and a target signal according to an exemplary embodiment.

Reference numeral 310 denotes a shock sound in a time domain, and reference numeral 320 denotes a voice signal that is a target signal in the time domain. Referring to the reference numerals 310 and 320, sizes of the shock sound and the voice signal rapidly increase for a short time.

Reference numeral 330 denotes a voice signal of a frequency domain corresponding to the shock sound 310 and the voice signal 320. In the voice signal in the frequency domain, energy of a high frequency domain is not larger than energy of a low frequency domain, and energy evenly spreads in a certain frequency section. However, in the shock sound, energy of a high frequency domain is larger than energy of a low frequency domain, energy is concentrated in a high frequency section in comparison with the voice signal.

The terminal 100 may detect an audio signal including a shock sound by using a fact that energy of the shock sound is concentrated in a high frequency section in comparison with a voice signal. For example, the terminal device 100 may detect an audio signal including a shock sound based on an energy difference or rate between a high frequency domain and a low frequency domain.

Figure 4:
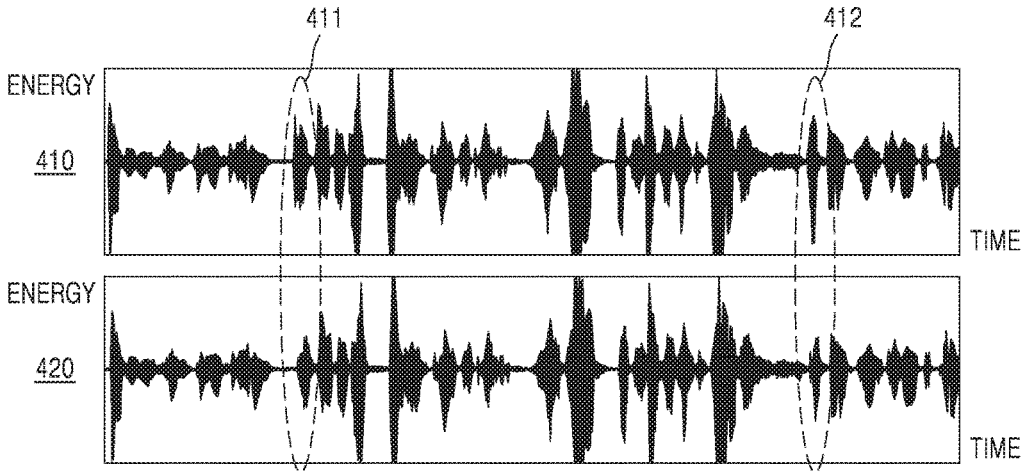
FIG. 4 illustrates a processed audio signal according to an exemplary embodiment.

FIG. 4 illustrates a processed audio signal according to an exemplary embodiment.

Reference numeral 410 denotes an audio signal that is not processed, and reference numeral 420 denotes an audio signal to which a suppression gain is applied so as to remove a shock sound therefrom. According to an exemplary embodiment, an audio signal including a shock sound may be detected based on an energy difference or rate between a high frequency domain and a low frequency domain. Therefore, a suppression gain may not be applied to sections 411 and 412 that do not correspond to a shock sound but have rapidly increasing energy sizes.

A method of processing an audio signal to remove noise according to another exemplary embodiment will now be described in more detail with reference to FIGS. 5 through 8.

Figure 5:
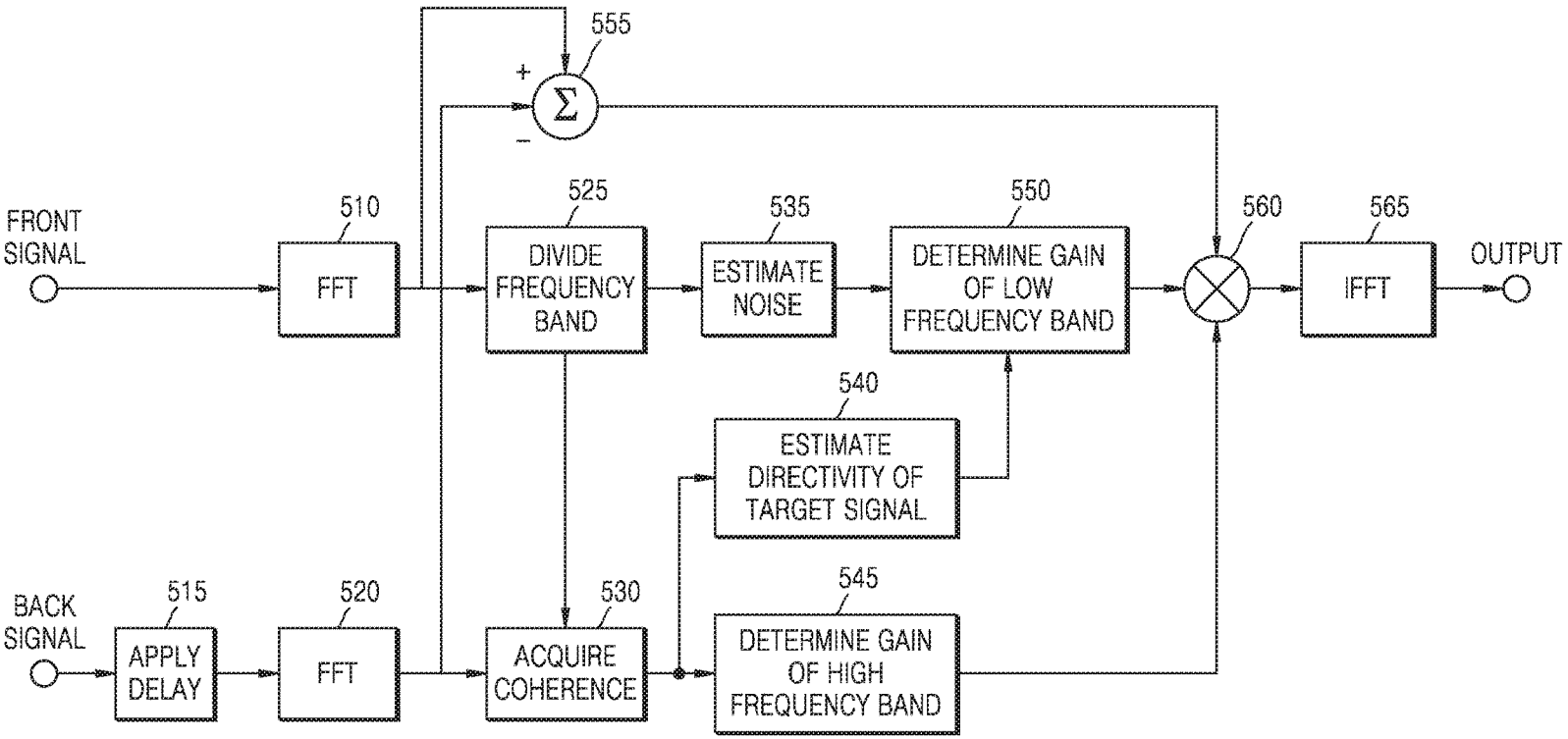
FIG. 5 is a block diagram of a method of processing an audio signal to remove noise according to an exemplary embodiment.

FIG. 5 is a block diagram of a method of processing an audio signal to remove noise according to an exemplary embodiment.

The method of FIG. 5 may be performed by the terminal device 100 described above. The terminal device 100 may include a microphone capable of receiving a sound generated from an external source to receive an audio signal through the microphone or receive an audio signal from an external apparatus.

The terminal device 100 may remove a shock sound of an audio signal according to the method described with reference to FIGS. 1 and 2 and process the audio signal according to the method of FIG. 5. The audio signal from which the shock sound is removed according to the method of FIGS. 1 and 2 may be divided into a front signal and a back signal to be acquired. Alternatively, the terminal device 100 may process the audio signal according to the method of FIG. 5 and remove the shock sound of the audio signal according to the method of FIGS. 1 and 2.

The terminal device 100 may include a front microphone for receiving the front signal and a back microphone for receiving the back signal. The front microphone and the back microphone may be located to keep a certain distance from each other and receive different audio signals according to directivities of the audio signals. The terminal device 100 may remove noise of an audio signal by using a directivity of the audio signal.

If the terminal device 100 is attached to an ear of the user to be used like a hearing device, the front and back microphones may collect sounds coming from various directions. For example, if the user faces another speaker to talk to the another speaker, the terminal device 100 may process a sound coming from a front of the user as a target signal and process a sound having no directivity as noise. The terminal device 100 may perform audio signal processing for removing noise based on a difference between audio signals collected through the front and back microphones.

For example, the terminal device 100 may perform audio signal processing for removing noise based on a coherence indicating a match degree between front and back signals. If the front and back signals match each other, the front and back signals may be determined as noises having no directivities. Therefore, as a coherence value is large, the terminal device 100 may determine that a corresponding audio signal includes noise and apply a gain value lower than 1 to the audio signal.

If the terminal device 100 is attached onto a body of the user to be used like the hearing device, a distance between the front and back microphones may be designed to be between about 0.7 cm and about 1 cm to make the terminal device 100 small. However, as the distance between the front and back microphones becomes narrower, a correlation between audio signals received through the front and back microphones becomes higher. Therefore, a noise removing performance using a directivity of a signal may be lowered.

The terminal device 100 according to an exemplary embodiment may apply a delay to the back signal and perform noise moving based on a coherence between the front signal and the back signal to which the delay is applied. As the delay is applied to the back signal, a coherence value of a front audio signal may become smaller, and a coherence value of a back audio signal may become larger. Therefore, although a correlation between audio signals becomes higher due to the narrowness between the front and back microphones, a coherence value of a front audio signal including a target signal is determined as a smaller value, and thus a noise removing performance may be improved.

Referring to FIG. 5, Fast Fourier Transforms (FFTs) may be performed in operations 510 and 520 to convert a front signal and a back signal, to which a delay is applied, into signals of a frequency domain in operation 515. A conversion method is not limited to FFT described above, and various methods for converting audio signals into signals of a frequency domain may be used. The delay applying 515 to the back signal and the FFT 520 may be performed in opposite orders without being limited in the illustrated orders.

Since a directivity of an audio signal is low in a low frequency band, a coherence value of a front audio signal may be determined as a value close to 1. Therefore, the terminal device 100 may acquire a gain value of the low frequency band based on a coherence value of a high frequency band instead of acquiring a coherence value of the low frequency band.

In operations 525 and 530, the terminal device 100 may divide a frequency band into at least two sections and acquire a coherence value between the front signal and the back signal to which the delay is applied, in the high frequency band. In operation 525, the terminal device 100 may divide a frequency band into a plurality of sections based on a frequency band having a high correlation due to the narrow distance between the front and back microphones.

For example, a coherence value $\Gamma_{fb}$ may be determined as a value between 0 and 1 as in Equation 6 below. As front and back signals have a high correlation, a coherence value may be determined as a value close to 1.

$$\phi_{ff}(w_h, n) = \alpha \times \phi_{ff}(w_h, n-1) + (1-\alpha) \times |Y_f(w_h, n)|^2 \tag{6}$$

$$\phi_{bb}(w_h, n) = \alpha \times \phi_{bb}(w_h, n-1) + (1-\alpha) \times |Y_b(w_h, n-\delta)|^2$$

$$\phi_{fb}(w_h, n) = \alpha \times \phi_{fb}(w_h, n-1) + (1-\alpha) \times Y_f(w_h, n) \times Y_b^*(w_h, n-\delta)$$

$$\Gamma_{fb}(w_h, n) = \frac{\phi_{fb}(w_h, n)}{\phi_{ff}(w_h, n)\phi_{bb}(w_h, n)}$$

wherein $\varphi_{ff}$ and $\varphi_{bb}$ respectively denote power spectral densities (PSDs) of the front signal and the back signal to which a delay $\delta$ is applied, and $\varphi_{fb}$ denotes a cross power spectral density (CSD). $\alpha$ may be determined as a value between 0 and 1. A coherence value indicating a correlation between the front and back signals may be determined based on the PSDs of the front signal and the back signal to which the delay is applied $\delta$. The coherence value is not limited to the above-described example and thus may be determined according to various methods.

As the coherence value is determined by using the back signal to which the delay is applied, a coherence value of a front audio signal may be determined to be smaller, and a coherence value of a back audio signal may be determined to be larger. Therefore, although a correlation between audio signals is high due to a narrow distance between the front and back microphones, a coherence value of a front audio signal including a target signal may be determined as a smaller value, and thus a noise removing performance may be improved.

In operation 545, the terminal device 100 may determine a gain value, which may be applied to a high frequency band, based on a coherence value. For example, a gain value $G_h$ may be determined as in Equation 7 below:

$$G_h(w_h, n) = 1 - f\{\Gamma_{fb}(w_h, n)\} \tag{7}$$

wherein the gain value $G_h$ may be determined as a value varying according to a frequency value $w_h$. A coherence value of a frequency component including a front audio signal may have a value close to 0, and thus a gain may be determined as a value close to 1. Therefore, a size of the frequency component including the front audio signal may be kept as it is. On the contrary, a coherence value of a frequency component including a back audio signal may have a value close to 1, and thus a gain may be determined as a value close to 0. Therefore, a size of the frequency component including the back audio signal may be reduced.

The gain value $G_h$ may be determined based on a real number part of a coherence value, an imaginary number part of the coherence value, or a magnitude of the coherence value. The gain value $G_h$ is not limited to the above-described example and thus may be determined according to various methods based on the coherence value.

A gain value of a low frequency band that may be determined in operation 550 may be determined based on a coherence value of a high frequency band as described above. For example, a gain value $G'_l$ of a low frequency band may be determined as in Equation 8:

$$G_l(w_l, n) = f\{Y_f(w_l, n), \tilde{N}_f(w_l, n)\}$$

$$G_l(w_l, n) = f\{G_l(w_l, n), \Gamma_{fb}(w_h, n)\} \tag{8}$$

In operation 535, a noise signal $N_f$ included in a front signal $Y_f$ may be estimated to determine the gain value $G_l$. Noise included in a front audio signal may be estimated according to various methods. For example, the terminal device 100 may detect the noise included in the front audio signal based on a characteristic of a noise signal. As the noise signal is large, the gain value $G_l$ may be determined as a small value so as to make a size of a corresponding frequency component small.

Also, in operation 550, a gain value $G'_l$ may be determined based on the gain value $G_l$ and a coherence value $\Gamma_{fb}$ of a high frequency band. In operation 540, the terminal device 100 may estimate a directivity of a target signal according to variations in the coherence value $\Gamma_{fb}$ and determine a gain value $G'_l$ of a low frequency band based on the directivity of the target signal. For example, if the target signal is front, a coherence value may be a value close to 0 in a certain frequency component. The certain frequency component may be determined according to a characteristic of the target signal. If the target signal is a speech signal, the certain frequency component may be determined in a section between about 200 Hz and about 3500 Hz that is a frequency section of a voice. If a direction of the speech signal is a back direction, a coherence value may be a value close to 1 in a certain frequency section.

If the target signal is front, the terminal device 100 may determine the gain value $G'_l$ of the low frequency band as the gain value $G_l$ to suppress a noise component according to the estimated noise signal. If the target signal is back, the terminal device 100 may determine the gain value $G'_l$ of the low frequency band as a value smaller than the gain value $G_l$ to suppress a back target signal and a noise component together.

In operation 555, the terminal device 100 may acquire a difference between the front signal and the back signal, to which the delay is applied, so as to acquire a fixed beamforming signal. The fixed beamforming signal may include an audio signal where a back audio signal is removed, and a front audio signal is reinforced. For example, the fixed beamforming signal may be acquired as in Equation 9 below.

$$Y_{fc}(w,n)=Y_f(w_{fc},n)-Y_b(w_{fc},n-\delta) \quad (9)$$

In operation 560, the terminal device 100 may apply the gain value acquired in operations 540 and 555 to the fixed beamforming signal to remove a back noise signal. For example, the gain value may be applied to the fixed beamforming signal as in Equation 10 below.)

$$\tilde{X}_h=G_h(w_h,n)\times Y_{fc}(w_h,n)$$

$$\tilde{X}_l(w_l,n)=G_l(w_l,n)\times Y_{fc}(w_l,n) \quad (10)$$

Also, in operation 565, the terminal device 100 may perform inverse FFT (IFFT) to convert a signal of a frequency domain into a signal of a time domain and output the signal of the time domain.

Figure 6:
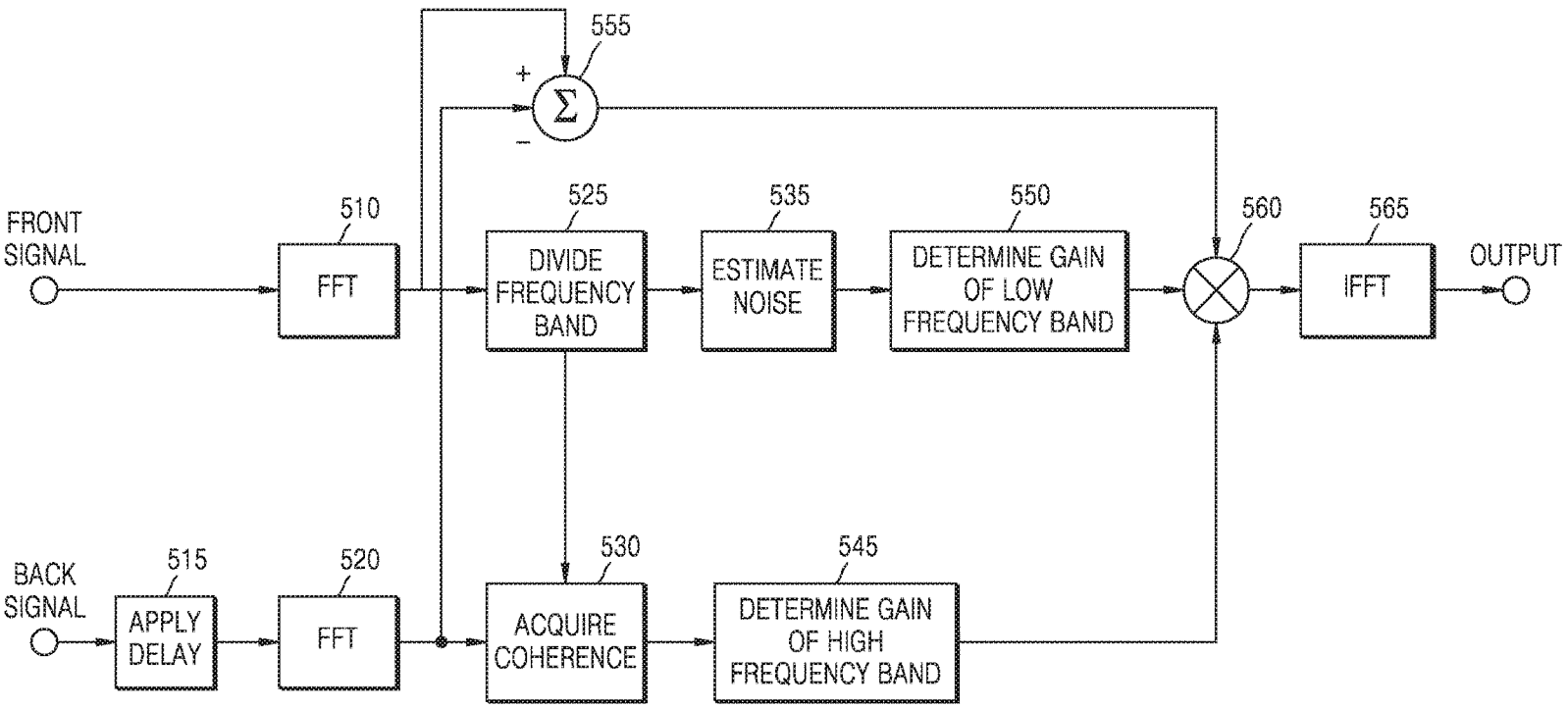
FIG. 6 is a block diagram of a method of processing an audio signal to remove noise according to an exemplary embodiment.

FIG. 6 is a block diagram of a method of processing an audio signal for moving noise according to an exemplary embodiment. Differently from the exemplary embodiment of FIG. 5, a gain of a low frequency band may be determined without operation 540 of estimating a directivity of a target signal. Referring to FIG. 6, the gain of the low frequency band may be determined a gain $G_l$ that is determined based on estimated noise of a front signal.

Figure 7:
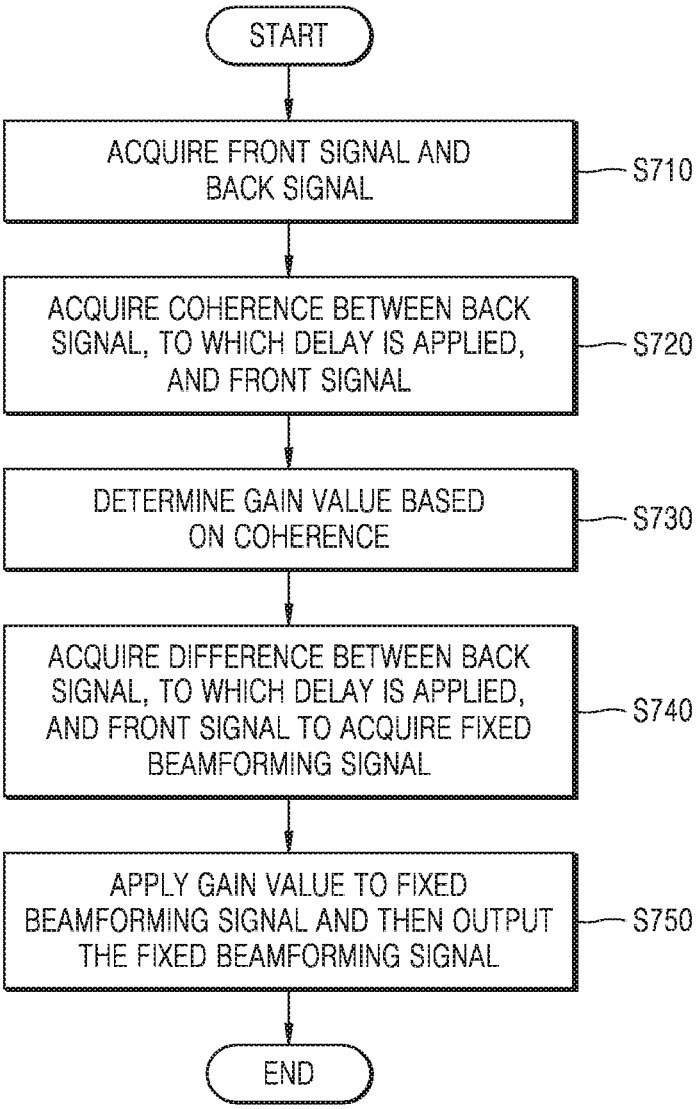
FIG. 7 is a flowchart of a method of processing an audio signal to remove noise according to an exemplary embodiment.

FIG. 7 is a flowchart of a method of processing an audio signal for removing noise according to an exemplary embodiment.

Referring to FIG. 7, in operation S710, the terminal device 100 may acquire a front signal and a back signal of an audio signal. The terminal device 100 may acquire the front and back signals through front and back microphones.

In operation S720, the terminal device 100 may acquire a coherence value between the back signal, to which a delay is applied, and the front signal. The terminal device 100 may apply the delay to the back signal and then acquire the coherence value between the back signal, to which the delay is applied, and the front signal. Therefore, although a correlation between audio signals becomes higher due to a narrow distance between the front and back microphones, the terminal device 100 may determine a coherence value of a front audio signal including a target signal as a smaller value, and thus a noise removing performance may be improved.

In operation S730, the terminal device 100 may determine a gain value based on the coherence value. As the coherence value is close to 1, the coherence value corresponds to the back signal. Therefore, the gain value may be determined so as to remove the back signal. As the coherence value is close to 0, the coherence value corresponds to the front signal. Therefore, the gain value may be determined so as to keep the front signal.

In operation S740, the terminal device 100 may acquire a difference between the back signal, to which a delay is applied, and the front signal to acquire a fixed beamforming signal. The fixed beamforming signal may include an audio signal where a back audio signal is removed, and a front audio signal is reinforced.

In operation S750, the terminal device 100 may apply the gain value determined in operation S730 to the fixed beamforming signal and then output the fixed beamforming signal. The terminal device 100 may convert the fixed beamforming signal, to which the gain value is applied, into a signal of a time domain and output the signal of the time domain.

Also, if a directivity of an audio signal is low in a low frequency band, a coherence value of a front audio signal may also be determined as a value closed to 1. Therefore, the terminal device 100 may estimate a noise signal of a front signal in the low frequency band and acquire a gain value for removing noise of the low frequency band based on the estimated noise signal. The terminal device 100 may also determine a directivity of a target signal based on a coherence value of a high frequency band and acquire a gain value of the low frequency band based on the directivity of the target signal.

Figure 8:
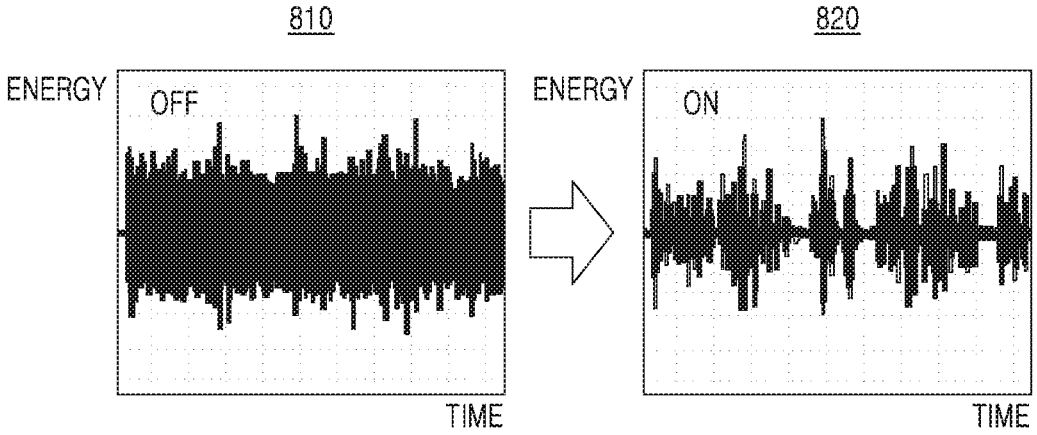
FIG. 8 illustrates a method of processing an audio signal to remove noise according to an exemplary embodiment.

FIG. 8 illustrates a method of processing an audio signal for removing noise according to an exemplary embodiment.

Reference numeral 810 denotes an audio signal from which noise is not removed according to the exemplary embodiments of FIGS. 5 through 7. Also, reference numeral 820 denotes an audio signal from which noise is removed according to the exemplary embodiments of FIGS. 5 through 7. According to a method of processing an audio signal according to an exemplary embodiment, a delay may be applied to a back signal so as to effectively remove the back signal.

Figure 9:
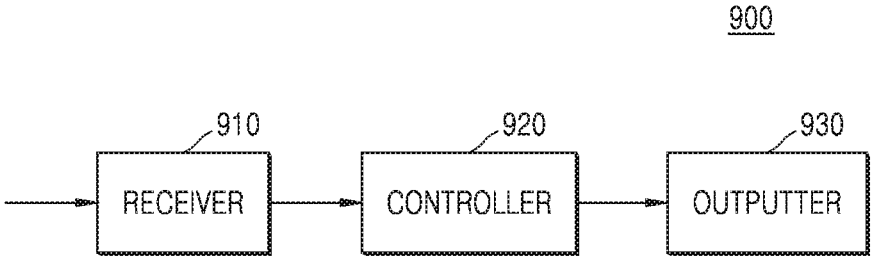
FIG. 9 is a block diagram of an internal configuration of an apparatus for processing an audio signal according to an exemplary embodiment.

FIG. 9 is a block diagram of an internal configuration of an apparatus for processing an audio signal according to an exemplary embodiment.

Referring to FIG. 9, a terminal device 900 processes an audio signal and includes a receiver 910, a controller 920, and an outputter 930.

The receiver 910 may receive an audio signal through a microphone. Alternatively, the receiver 910 may receive an audio signal from an external apparatus. The receiver 910 may respectively receive a front signal and a back signal through front and back microphones.

The controller 920 may detect noise from the audio signal received by the receiver 910 and apply a suppression gain to the audio signal of an area from which noise is detected, to perform noise removing. The controller 920 may detect an area including a shock sound based on an energy difference between frequency bands and apply a suppression gain to the detected area. The controller 920 may also determine a gain value, which will be applied to an audio signal, based on a coherence between the back signal, to which the delay is applied, and the front signal to remove the back signal from the audio signal.

The outputter 930 may convert the audio signal processed by the controller 920 into a signal of a time domain and output the signal of the time domain. The outputter 930 may convert an audio signal, which is acquired by applying a gain value to an audio signal of a partial section by the controller 920, into a signal of a time domain and output the signal of the time domain. The outputter 930 may also apply the gain value determined based on the coherence to a fixed beamforming signal of an audio signal and then output the fixed beamforming signal of the audio signal.

For example, the outputter 930 may output an audio signal of a time domain through a speaker.

According to a method of processing an audio signal according to an exemplary embodiment, a distortion of a sound quality of an audio signal may be reduced, and noise included in the audio signal may be effectively removed.

A method according to exemplary embodiments may be embodied in a program command form that may be executed through various types of computer units to be recorded on a non-transitory computer readable medium. The non-transitory computer readable medium may include a program command, a data file, a data structure, or combinations thereof. The program command recorded on the non-transitory computer readable medium may be particularly designed and configured for the exemplary embodiments or may be well-known by a computer software business operator to be used. Examples of the non-transitory computer readable medium includes a magnetic media such as a hard disk, a floppy disk, and a magnetic tape, an optical media such as a CD-ROM and DVD, a magneto-optical media such as a floptical disk, and a hardware device that is particularly configured to store and perform a program command like a read only memory (ROM), a random access memory (RAM), a flash memory, or the like. Examples of the program command includes a machine language code that is made by a compiler and a high-level language code that may be executed by a computer by using an interpreter or the like.

While one or more exemplary embodiments have been described with reference to the figures, it will be understood by those of ordinary skill in the art that various changes in form and details may be made therein without departing from the spirit and scope as defined by the following claims.

The invention claimed is:

1. A method of processing an audio signal in a terminal device, the method comprising:

acquiring an audio signal of a frequency domain for a current frame;

dividing a frequency band into a plurality of sections;

acquiring energies of a first section and a second section from among the plurality of sections;

determining whether the audio signal of the current frame includes noise based on an energy difference between the first section and the second section; and applying a suppression gain to the audio signal of the current frame and outputting the audio signal of the current frame applied the suppression gain, based on a result of determining, wherein the first section and the second section are non-overlapped in the frequency band, and wherein at least one of the first section and the second section is determined as a shock noise section based on the energy difference.

2. The method of claim 1, wherein the determining whether the current frame of the audio signal includes the noise comprises:

acquiring energies of the current frame and another frame, the another frame being adjacent to the current frame; and determining whether the audio signal of the current frame includes the noise based on an energy difference between the current frame and the another frame.

3. The method of claim 1, wherein the applying of the suppression gain comprises determining the suppression gain based on energy of the audio signal of the current frame.

4. The method of claim 1, wherein the second section includes low frequency sections among the plurality of sections and the first section includes high frequency sections among the plurality of sections, and if energy of the first section is greater than or equal to a reference value in comparison with energy of the second section, the determining comprises determining that the audio signal of the current frame includes noise.

5. A non-transitory computer-readable recording medium storing a program for implementing the method of claim 1.

6. The method of claim 1, wherein the determining whether the audio signal of the current frame includes the noise comprises:

acquiring energy of the audio signal of the current frame; and determining whether the audio signal of the current frame includes the noise based on the energy of the audio signal of the current frame.

7. A method of processing an audio signal in a terminal device, the method comprising:

acquiring a first audio signal and a second audio signal from a first microphone and a second microphone, respectively, the first audio signal and the second audio signal including a target audio signal;

determining a coherence value based on a match degree between the first audio signal and the second audio signal;

determining a first frequency section and a second frequency section in a frequency band;

determining a first gain for removing a noise signal of the first audio signal and the second audio signal in the first frequency section, based on the coherence value;

determining a directivity of the target audio signal, based on variations of the coherence value in a certain frequency band;

determining a second gain for removing the noise signal of the first audio signal and the second audio signal in the second frequency section, based on the directivity of the target audio signal;

generating a third audio signal from the first audio signal and the second audio signal by removing the noise signal of the first audio signal and the second audio signal in the first frequency section and the second frequency section using the first gain and the second gain; and outputting the third audio signal via a speaker.

8. The method of claim 7, wherein the certain frequency band is determined based on a type of the target audio signal.

9. The method of claim 7, wherein the third audio signal is a fixed beamforming signal generated from a difference signal between the first audio signal and the second audio signal, to which a delay is applied.

10. A terminal device for processing an audio signal, the terminal device comprising:

a receiver configured to acquire an audio signal of a frequency domain for a current frame;

a controller configured to divide a frequency band into a plurality of sections, acquire energies of a first section and a second section from among the plurality of sections, determine whether the audio signal of the current frame includes noise based on an energy difference between the first section and the second section, and apply a suppression gain to the audio signal of the current frame based on a result of determination; and a speaker configured to output the audio signal of the current frame applied the suppression gain based on the result of the determination, wherein the first section and the second section are non-overlapped in the frequency band, and wherein at least one of the first section and the second section is determined as a shock noise section based on the energy difference.

11. The terminal device of claim 10, wherein the controller is further configured to acquire energies of the current frame and another frame, the another frame being adjacent to the current frame, and determine whether the audio signal includes the noise based on an energy difference between the current frame and the another frame.

12. The terminal device of claim 10, wherein the controller is further configured to determine the suppression gain based on energy of the audio signal of the current frame.

13. The terminal device of claim 10, wherein the second section includes low frequency sections among the plurality of sections and the first section includes high frequency sections among the plurality of sections, and if energy of the first section is greater than or equal to a reference value in comparison with energy of the second section, the controller is further configured to determine that the audio signal of the current frame includes noise.

14. The terminal device of claim 10, wherein the controller is further configured to acquire an energy of the audio signal of the current frame, and determine whether the audio signal of the current frame includes the noise based on the energy of the audio signal of the current frame.

* * * * *